US005144197A

United States Patent [19]

Peters et al.

[11] Patent Number: 5,144,197

[45] Date of Patent: Sep. 1, 1992

[54] DISPLAY DEVICE HAVING WALLS FOR PASSAGE OF ELECTRON BEAMS

[75] Inventors: Petrus J. M. Peters; Henricus A. A. R. Crooijmans, both of Eindhoven, Netherlands

[73] Assignee: U.S. Philips Corporation, New York, N.Y.

[21] Appl. No.: 448,031

[22] Filed: Dec. 8, 1989

[30] Foreign Application Priority Data

Dec. 15, 1988 [NL] Netherlands ..... 8803065

[51] Int. Cl.[5] ..... H01J 29/72

[52] U.S. Cl. ..... 313/422; 313/243; 313/423; 313/426; 313/446; 313/460

[58] Field of Search ..... 313/422, 423, 426, 432, 313/436, 446, 447, 448, 449, 458, 460, 243

[56] References Cited

U.S. PATENT DOCUMENTS

| | | | |
|---|---|---|---|
| 4,622,492 | 11/1986 | Barten | 313/422 |
| 4,642,517 | 2/1987 | Kanehisa et al. | 313/422 X |
| 4,853,585 | 8/1989 | Hoeberechts et al. | 313/426 X |
| 4,853,586 | 8/1989 | Peters | 313/422 |

FOREIGN PATENT DOCUMENTS

| | | | |
|---|---|---|---|
| 0165254 | 12/1981 | Japan | 313/422 |

*Primary Examiner*—Donald J. Yusko
*Assistant Examiner*—Ashok Patel
*Attorney, Agent, or Firm*—John C. Fox

[57] ABSTRACT

A display device having a row of emitting elements and an electron-optical system for the electron beams emitted by the said elements. The electron-optical system includes bodies to which common row electrodes are secured so that the assembly of the electron-optical system is simplified. The electrodes may be provided either as separate elements fitting into slots in the body walls, or as layers on the walls, formed for example by vacuum evaporation.

8 Claims, 5 Drawing Sheets

DISPLAY DEVICE HAVING WALLS FOR PASSAGE OF ELECTRON BEAMS

BACKGROUND OF THE INVENTION

The invention relates to a display device comprising a display screen, means for emitting a row of electron beams and an electron-optical system for the row of electron beams, the system comprising at least one common electrode for the row of electron beams.

Such a display device is known from U.S. Pat. No. 4,853,586.

In the known display device the electron-optical system comprises common electrodes which are suspended from and connected to conducting pins. An electron beam is associated with a vertical column of the image. Such a display device is said to be not very suitable for mass production.

OBJECT AND SUMMARY OF THE INVENTION

It is an object of the invention to provide a display device of the type mentioned in the opening paragraph, which is more suitable for mass production.

To this end, a display device according to the invention is characterized in that the display device comprises bodies, having facing walls, said walls forming a cavity for the passage for the electron beams, and between which walls at least one electrode extends and to which walls the at least one common row electrode is attached.

This arrangement allows electrodes to be positioned in a simple manner, and results in improved mechanical strength as well as microphonic behaviour of the electron optial system.

In an embodiment, the walls define slots which extend in a direction parallel to the row and which accomodate the at least one electrode, which in this embodiment is plate-shaped.

The plate-shaped electrode can be simply secured in the slots.

Preferably, the at least one electrode is attached to the walls at one location approximately in the middle of the row of electron beams, so that problems caused by the warming-up of the at least one electrode are reduced.

In another embodiment, a tag is provided at least one end of the at least one electrode.

The tag can be provided with an electric contact in a simple manner.

In still another embodiment, the bodies are provided with conducting channels which end in the slots.

Preferably, the slots comprise means for establishing an electrical contact between the conducting channels and the said electrode.

In a further embodiment, the slots are conically shaped.

In a further embodiment, the at least one electrode is provided as a conducting layer on the walls.

To assemble the electron-optical system, the electrodes are provided on the bodies. By virtue thereof, only the bodies have to be positioned relative to one another during the assembling operation.

Preferably, the portions of the walls which are not covered by conducting layers are arranged so as to be recessed relative to the portions of the walls which are covered by conducting layers. In this manner, the risk of the walls becoming charged which has an adverse effect on the path of the electrons is reduced.

In a further embodiment, the electrodes are provided by means of vacuum evaporation.

The at least one electrode can be provided in a simple and reproducible manner by carrying out the vacuum evaporation operation in an oblique position relative to the slots. Consequently, the side faces of the slots are covered by conducting material which prevents them from becoming charged.

BRIEF DESCRIPTION OF THE DRAWING

The invention will be explained in greater detail in terms by means of a few embodiments and with reference to the accompanying drawing, in which.

The figures are diagrammatic and not to scale; corresponding parts generally bear the same reference numerals.

DESCRIPTION OF PREFERRED EMBODIMENTS

Figure 1:
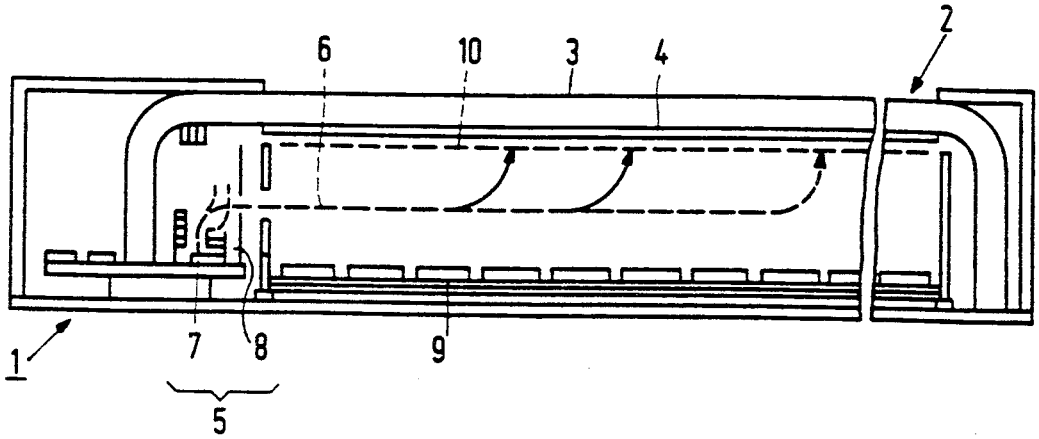
FIG.1 PRIOR ART
FIG. 1 is a sectional view of the known display device.

FIG. 1 is a sectional view of the known display device. A display device 1 comprises an envelope 2 accommodating a display window 3 which is provided with a display screen 4 on the inside. The display device 1 further comprises a generation system 5 for generating a row of electron beams 6, said generation system comprising a number of emitting elements 7 and an electron-optical system 8. The electron-optical system 8 ensures, inter alia, that the electron beams emitted by the elements 7 are accelerated. In the present example, the electron beams emerging from the electron-optical system 8 extend in a direction parallel to the display screen 4. Subsequently, the electron beams are deflected towards the display screen 4 by deflection electrodes 9. In the present example, a shadow mask 10 is arranged in front of the display screen 4.

Figure 2:
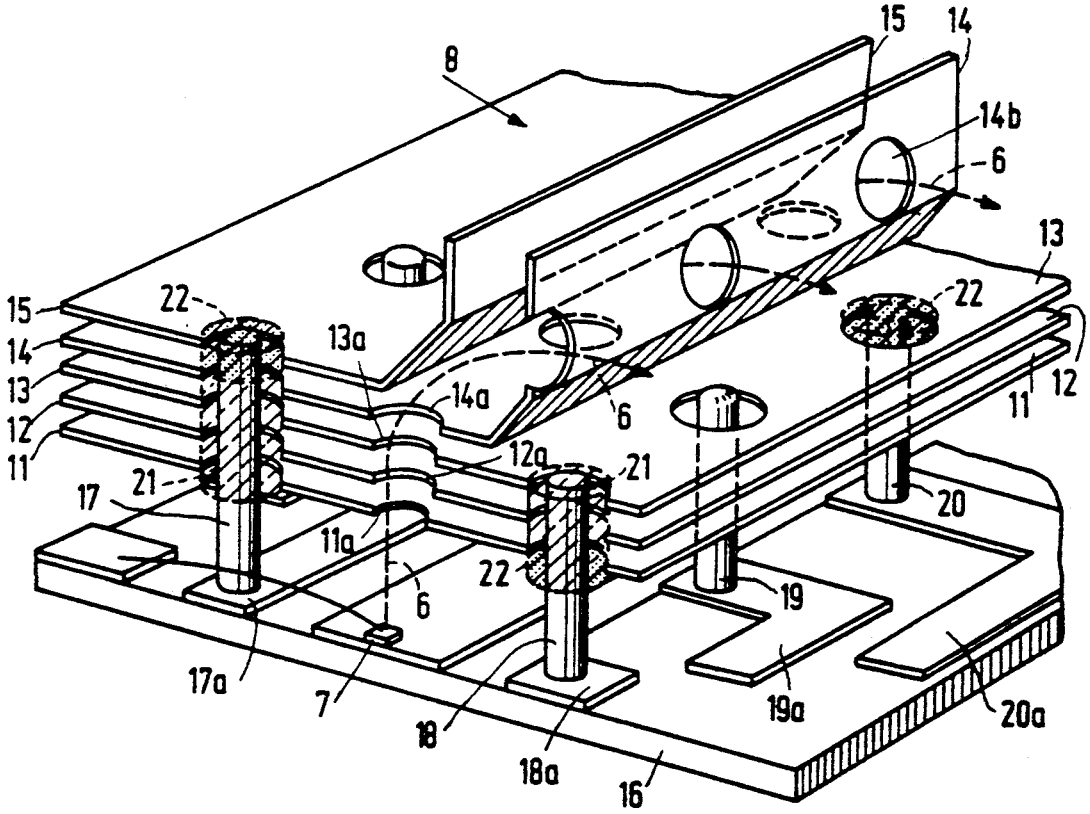
FIG.2 PRIOR ART
FIGS. 2 and 3 are perspective and sectional views, respectively, of the electron optical system of a detail of the known display device.
Figure 3:
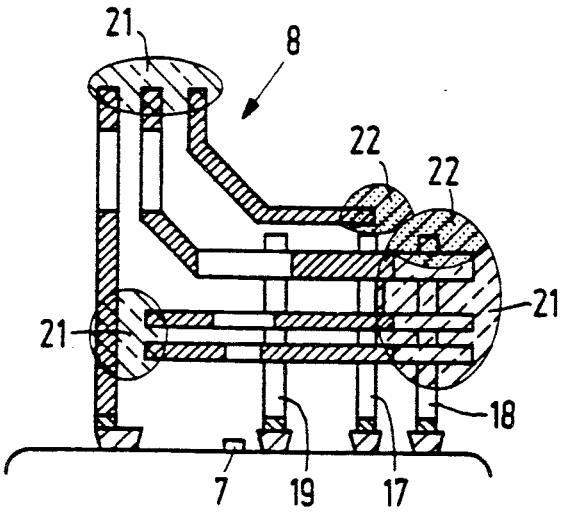
FIG.3 PRIOR ART

FIG. 2 is a perspective view of a part of the electron-optical system 8. The electron-optical system 8 comprises a number of electrodes 11 to 15, having apertures 11*a*, 12*a*, 13*a*, 14*a* and 14*b*, a base plate 16 and a number of conducting pins 17 to 20, which are connected to conducting strips 17*a* to 20*a* respectively. The pins and the electrodes are interconnected mechanically by glass connections 21 and electrically by conducting connections 22. The electrodes may also be connected to one another by means of glass connections.

A display device having such an electron-optical system is very suitable for mass production. The electrodes must be properly aligned relative to one another, both in a direction along the electron beams and in a direction perpendicular thereto. If one pin is bent or positioned improperly, it may be impossible to position the electrodes properly. Care must be taken so that a conducting pin does not contact a "wrong" electrode. To form glass connections, the glass is heated to the melting point. This is time consuming and, after cooling, thermal stresses may be present which may lead to fracture of a pin or displacement of an electrode.

It is an object of the invention to provide a display device which is more suitable for mass production.

Figure 4:
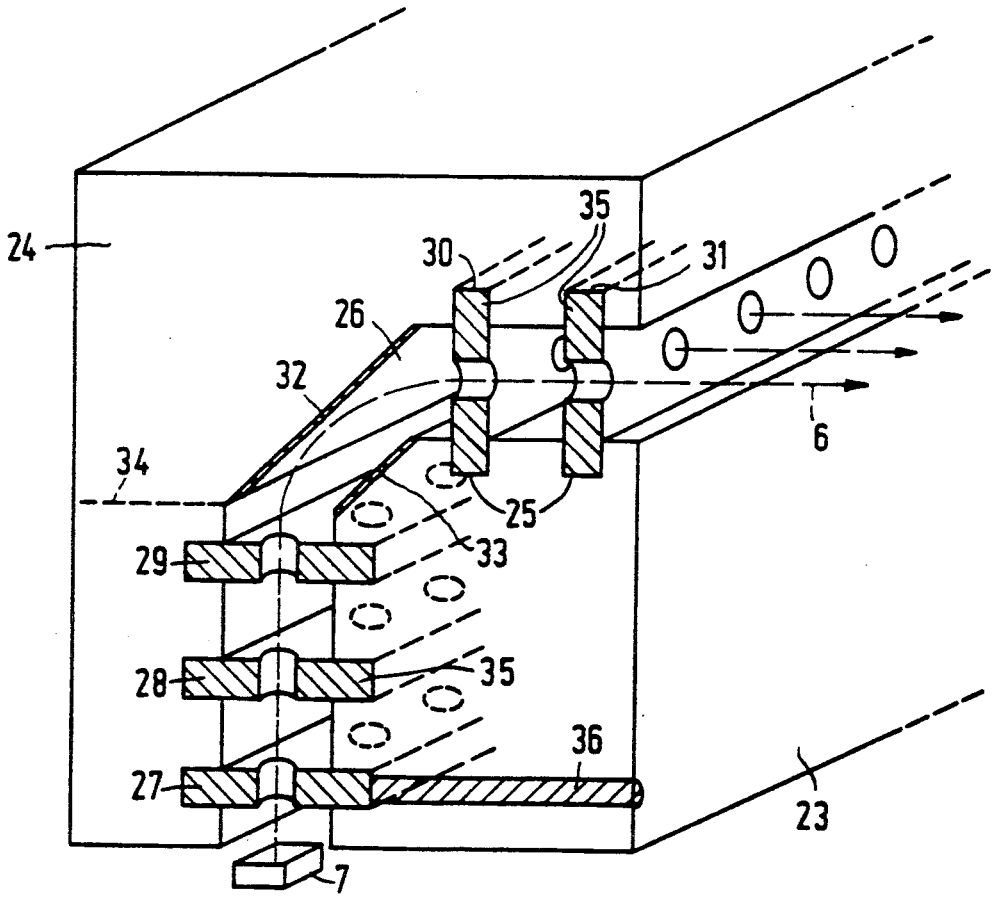
FIG. 4 is a perspective view of an electron-optical system for a display device according to the invention.

FIG. 4 is a perspective view of a detail of a display device according to the invention.

The electron-optical system comprises bodies 23 and 24 having slots 25. The bodies may consist of glass, ceramics, synthetic resin, quartz or any other non-conducting material or an assembly of non-conducting materials. The slots extend parallel to a row of emitting elements 7, only one of which is visible, for emitting a row of electron beams 6. Electrodes 27 to 31 extend in a passage 26 which is formed between the walls of the bodies. The electrodes 27, 28, 29, 30 and 31 are plate-shaped electrodes having apertures, and secured in the slots. The electron-optical system further comprises electrodes 32 and 33 which are provided as conducting layers. In the present example, the bodies are block-like, this is not to be regarded as limitative. For example, body 24 may be divided in two sub-bodies along the dotted line 34. Electrical contact with the electrodes can be established in various ways, for example, at the ends of the bodies by means of a contact 35 or by means of conducting channels 36 in the bodies 23 and/or 24, which channels end in the slots 25. In such a case, a slot may be provided with means to establish a proper electrical contact between the conducting channel and the electrode, for example a conducting adhesive, a thin indium layer or a clamping-spring contact. The slots 25 may be slightly wedge shaped. By virtue thereof, the introduction of the electrodes and the arrangement of the bodies can be carried out more readily. Electrodes may be provided on the input or output side of the bodies.

Figure 5A:
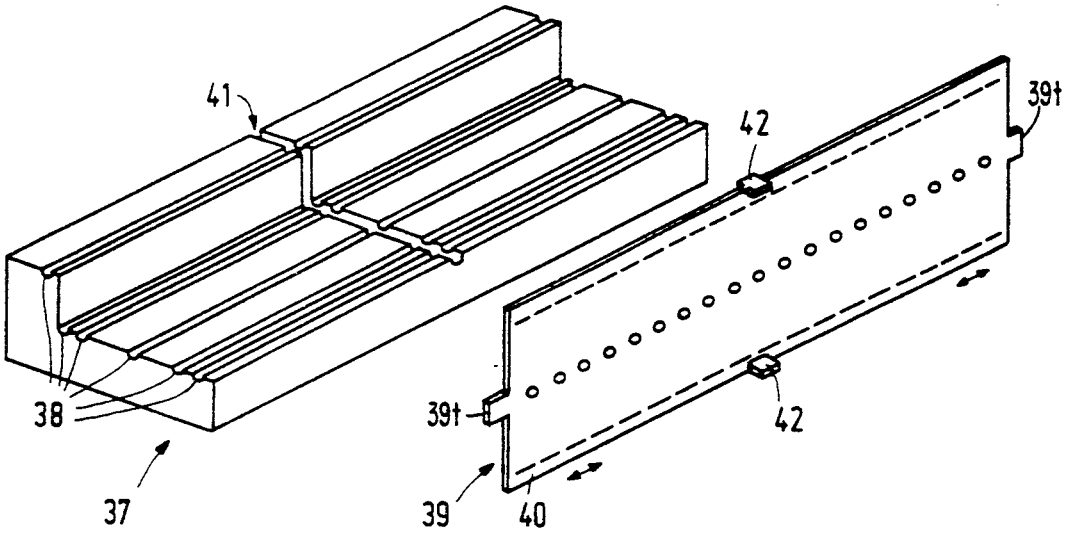
FIG. 5*a* is a perspective view of another embodiment of an electron-optical system for a display device according to the invention.

FIG. 5*a* is a perspective view of a body 37 in which slots 38 are formed. FIG. 5*a* further shows an electrode 39 having a portion 40 to be placed in one of the slots 38. The body 37 also comprises a transverse slot 41 which is located approximately in the middle of the body. The projections 42 of the electrode 39 fit in the transverse slot 41 and lock the electrode 39 in place. If the temperature changes, the electrode expands or shrinks, as indicated by the arrows. The electrode is not hindered in this movement, except at 42, so that no thermal stresses occur. The effect of the thermal expansion is small because the electrode is locked approximately in the middle. The electrode 39 further comprises tags 39*t* for establishing electric contact. In this example, the length of the body is substantially equal to the length of the electrode. This is not to be regarded as limitative. For example, the body may be longer than the electrode; so that the side faces of the electrode are protected. Contact can be established via the projecting tags 39*t*.

Figure 5B:
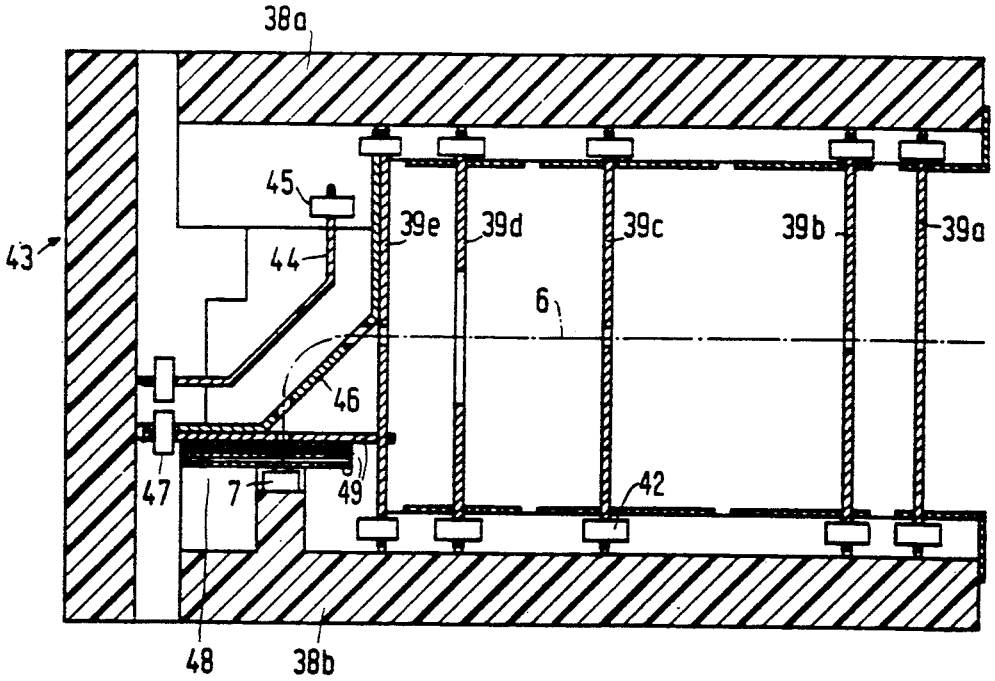
FIG. 5*b* is a sectional view of another embodiment of an electron-optical system of the invention.

FIG. 5*b* is a sectional view of an electron-optical system which is suitable for use in a display device according to the invention. The cross-sectional view is taken at a transverse slot 41. The electron-optical system comprises three bodies, viz. 38*a*, 38*b*, having approximately the shape as shown in FIG. 5*a*, and a body 43. The electron-optical system further comprises electrodes 39*a* to 39*e*, having approximately the shape as shown in FIG. 5*a*, which extend between the bodies 38*a* and 38*b* and which are locked in the electron-optical system by projections 42. The electron-optical system further comprises electrodes 44 and 46 which extend between bodies 43 and 38*a* and which are locked by projections 45 and 47, respectively. The electron-optical system further comprises a number of emitting elements 7 for emitting electron beams 6, and an electrode sub-system 48 containing a number of electrodes 49 which are accommodated in a recess in body 38*b* and which are separated from each other by insulating plates (not shown).

Figure 6:
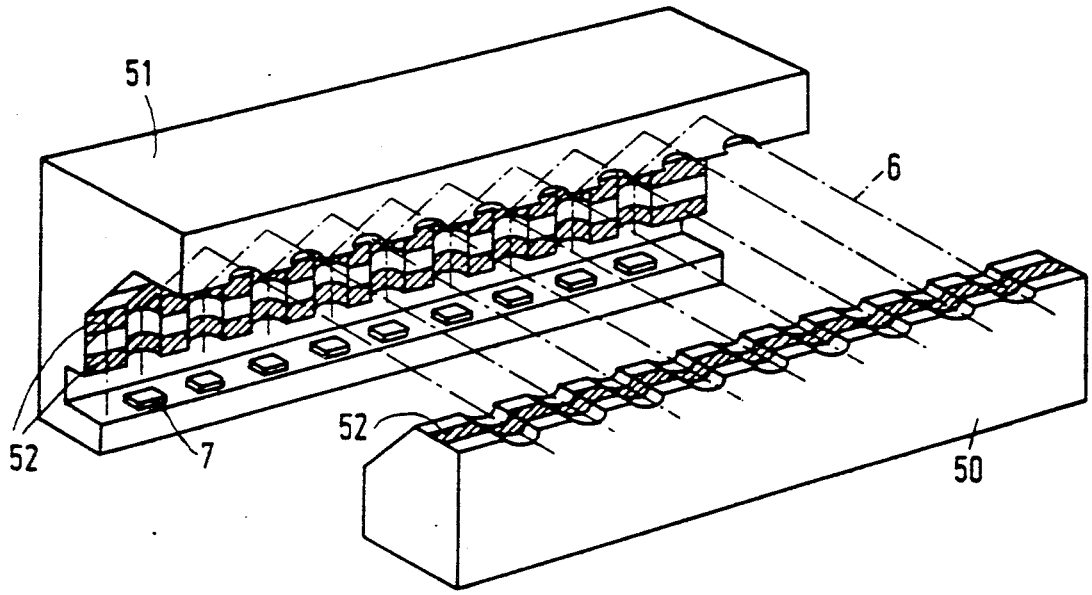
FIG. 6 is a perspective sectional view of a detail of an electron-optical system for a display device according to the invention.

FIG. 6 is perspective view of another embodiment of an electron-optical system for a display device according to the invention.

The electrodes are provided as conducting layers 52 on the bodies 50 and 51, the walls defining a plurality of rounded facing indentations, each pair of facing indentations forming a cavity for the passage of an electron beam. During assembly, the two bodies are placed against each other. In this manner, the assembly of the electron-optical system is simplified substantially. A disadvantage of the embodiment shown herein is, however, that charging phenomena may occur. The occurrence of these phenomena can be reduced by arranging the portions of the facing walls of the bodies which are not covered by conducting layers so that they are recessed relative to the portions which are covered by conducting layers, as is shown in FIG. 7.

Figure 7:
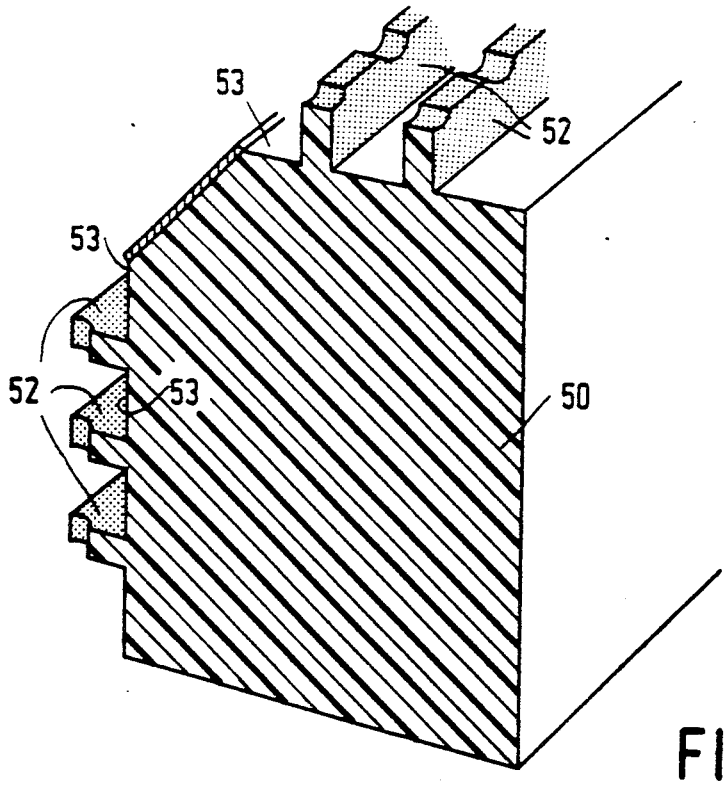
FIG. 7 is a perspective view of a detail of an electron-optical system for a display device according to the invention.

FIG. 7 is a sectional view of a body 50 which is provided with conducting layers 52. Portions 53 which are not covered by conducting layers are arranged so that they are recessed relative to the portions covered by conducting layers 52. The charging of the portions which are not covered by a conducting layer generally has a detrimental effect on the electron beams. The risk that an electron impinges on these portions is thus reduced and, hence, the risk that they are charged is also reduced.

Figure 8:
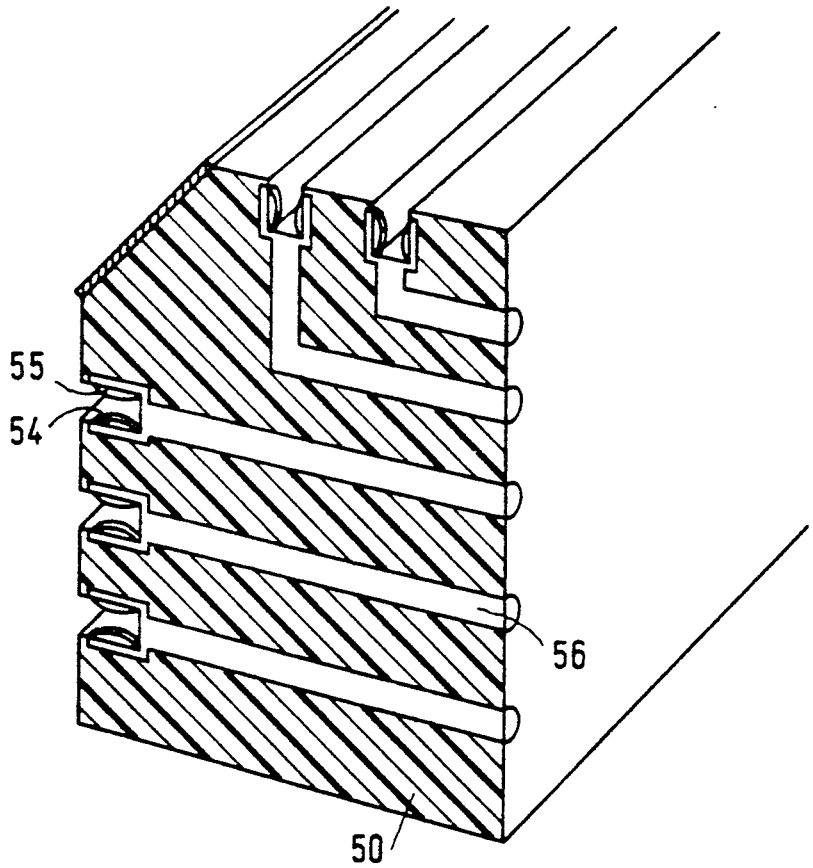
FIG. 8 is a perspective sectional view of another embodiment of a display device of the invention.

FIG. 8 is a perspective view of a body 50. In this example slots 54 are provided with clamping springs 55. These springs establish a proper electrical contact between the electrodes, not shown herein, and the conducting channels 56.

Figure 9:
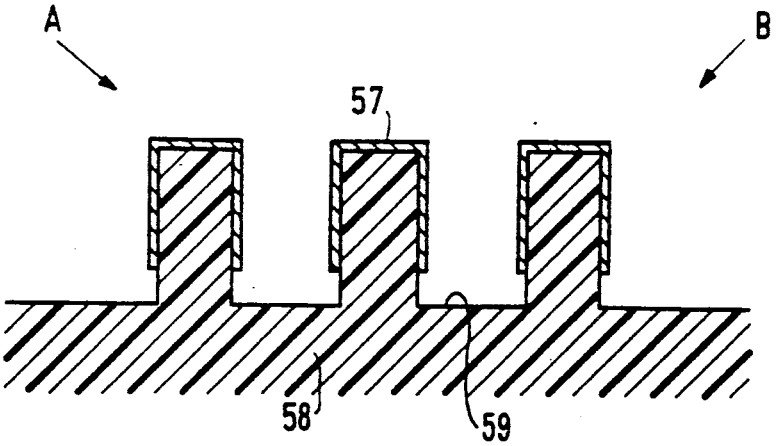
FIG. 9 is an elevation sectional view of an arrangement of conducting layers on a body in accordance with the invention.

FIG. 9 shows that the electrodes can be provided as conducting layers 57 on a body 58 (similar to conducting layers 52 and body 50 in FIG. 7) in a simple manner by means of vacuum evaporation from the directions A and B. The conducting layers also extend over the side faces of the recesses 59, similar to recesses 53 in FIG. 7. Consequently, these side faces cannot become charged.

It will be obvious that within the scope of the invention many variations are possible to those skilled in the art. Bodies as shown in FIGS. 4 and 8 may, inter alia, be connected to plate-shaped electrodes and, additionally, be provided with vacuum evaporated electrodes. The electron-optical system as shown in FIG. 5*b* may alternatively be provided with loosely stacked electrodes or a number of electrodes may be combined to form subsystems which are arranged between the bodies. The bodies may also contain a metal core which is provided with a non-conducting outer layer, for example a core of the same material as the material from which the electrodes are made, and an outer layer of aluminium oxide. If the core is made from the same material as the electrodes, a reduction of the thermal stresses which may be caused by the heating of the electrodes is obtained. In the Figures the bodies are always depicted as separate elements. The bodies may however be combined to form as assembly. The bodies do not all have to be made from the same material.

We claim:

1. A display device comprising a display screen, means for emitting a row of electron beams, and an electron-optical system for the row of electron beams, the system comprising at least two common electrodes for the row of electron beams, characterized in that the display device comprises two bodies having facing walls, said walls forming a cavity for the passage of the electron beams and in that the electrodes are provided as spaced-apart parallel strips of conducting layers on at least a portion of one of the walls.

2. A display device as claimed in claim 1, characterized in that portions of the walls which are not covered by conducting layers are arranged so that they are recessed relative to the portions of the walls which are covered by conducting layers.

3. A display device as claimed in claim 1, characterized in that the walls define a plurality of rounded facing indentations, each pair of facing indentations forming a cavity for the passage of an electron beam.

4. A display device comprising a display screen, means for emitting a row of electron beams and an electron-optical system for the row of electron beams, the system comprising at least one common electrode for the row of electron beams, said display device further comprising two bodies having facing walls, said walls forming a cavity for the passage of the electron beams, and the at least one common electrode extending between the walls and attached to the walls, characterized in that the walls have slots for the at least one electrode, which slots extend in a direction parallel to the row emitting means, in that the at least one electrode is plate shaped, and in that the bodies are provided with conducting channels which end in the slots.

5. A display device as claimed in claim 4, characterized in that the slots are provided with means for establishing an electrical contact between the conducting channels and said electrodes.

6. A display device as claimed in claim 5, characterized in that the means contain conducting adhesive.

7. A display device as claimed in claim 5, characterized in that the means contain an indium layer.

8. A display device as claimed in claim 5, characterized in that the means contain a clamping-spring contact.

* * * * *